United States Patent [19]

Hashizume

[11] 4,416,223

[45] Nov. 22, 1983

[54] HEAT EXCHANGERS

[75] Inventor: Kenichi Hashizume, Tokyo, Japan

[73] Assignee: Tokyo Shibaura Denki Kabushiki Kaisha, Kanagawa, Japan

[21] Appl. No.: 416,470

[22] Filed: Sep. 10, 1982

Related U.S. Application Data

[63] Continuation of Ser. No. 151,831, May 21, 1980, abandoned.

[51] Int. Cl.[3] ..... F22B 37/10

[52] U.S. Cl. ..... 122/367 C; 165/146; 165/181

[58] Field of Search ..... 165/146, 147, 181, 1; 122/367 R, 367 A, 367 C

[56] References Cited

U.S. PATENT DOCUMENTS

| | | | |
|---|---|---|---|
| 659,623 | 10/1900 | Mallet et al. | 122/367 A |
| 1,521,864 | 1/1925 | Broido | 122/367 C X |
| 1,921,735 | 8/1933 | Elrick | 122/367 C X |
| 3,476,180 | 11/1969 | Straight, Jr. et al. | 122/367 R X |

FOREIGN PATENT DOCUMENTS

| | | | |
|---|---|---|---|
| 1678390 | 5/1954 | Fed. Rep. of Germany . | |
| 7218549 | 8/1972 | Fed. Rep. of Germany . | |
| 7219330 | 8/1972 | Fed. Rep. of Germany . | |
| 743795 | 4/1933 | France | 165/181 |

*Primary Examiner*—Albert W. Davis, Jr.
*Attorney, Agent, or Firm*—Stevens, Davis, Miller & Mosher

[57] ABSTRACT

A heat exchanger includes therein heat transfer tube assemblies arranged in rows in a zigzag form. Each assembly comprises a tube, and a plurality of fins secured the outer surface of the tube, and the radial length of each fin facing an inlet of the heat exchanger for a high temperature gas to be supplied therethrough is constructed to be larger than that facing an opposing outlet thereof so as to effectively perform heat exchange between the supplied high temperature gas and a liquid passing through the heat transfer tube assembly.

1 Claim, 16 Drawing Figures

HEAT EXCHANGERS

Tthis is a continuation of application Ser. No. 151,831 filed May 21, 1980, now abandoned.

BACKGROUND OF THE INVENTION

This invention relates to an exchanger including improved heat transfer tube assemblies through which liquid passes and is heated by a high temperature gas supplied into the heat exchanger to vaporize the liquid.

In a boiler or evaporator of a heat exchanging system, heat transfer tube assemblies comprising a plurality of finned heat transfer tubes are horizontally arranged, and liquid passing through the inner lower portion of the heat transfer tube is heated by a high temperature gas such as combustion gas or exhaust gas in a factory.

During this heating operation, vapour generated in the finned heat transfer tube assemblies flows therein above the liquid. The vapour thus obtained can be utilized for generating power to operate, for instance, turbine.

Usually a heat transfer tube assembly comprises a tube and a plurality of fins which are secured to the entire outer surface of the tube and each of which has substantially the same radial length in all directions from the peripheral outer surface of the tube. In a case where such finned heat transfer assemblies are used, heat applied to the assembly by a hot gas supplied is transferred substantially equally to the tube through fins attached thereto.

When the liquid, which may contain more or less amount of harmful chemical materials, flows in the tube, a portion of the liquid forms a thin liquid film along the upper inner wall of the tube. However, when the tube is heated by a large amount of heat, the thin liquid film is evaporated, called a dry-out phenomenon hereunder, and harmful materials contained in the liquid film will adhere to the upper inner wall of the heat transfer tube and finally corrode and damage the tube. Moreover, in an evaporator for evaporating a medium having a low boiling point and low heat stability such as Freon (Registered Trade Mark), when such a dry-out phenomenon as described above occurs, the tube is locally highly heated and the adhered medium will be thermally cracked, thus damaging the tube. For this reason, in order to avoid the corrosion of the tube due to the adhesion of the harmful materials contained in the liquid, it was required to remove beforehand the harmful chemical materials in the liquid to be heated by suitable liquid treatment means or to construct a tube with anti-corrosion material. However, the liquid pretreatment requires an additional device therefor and the anti-corrosion material utilized to construct the tubes is very expensive and uneconomical. More particularly, it is impossible to apply such expensive preliminary treatment as described above to a waste heat boiler which essentially requires a low establishment cost. Furthermore, in order to prevent the thermal cracking of the medium having a low boiling point due to excessive heating, a heat exchanger including heat transfer tube assemblies must be designed so as to reduce the heat amount to be applied to the tube to the extent that the liquid film formed at the upper inner portion of the tube would not be evaporated, but in such a case, the use of the finned heat transfer tube assemblies is limited. Moreover, a heat exchanger must be constructed to have a considerably large capacity for sufficiently absorbing the heat amount given by the high temperature gas.

SUMMARY OF THE INVENTION

Accordingly, an object of this invention is to provide a heat exchanger including improved heat transfer tube assemblies to be horizontally arranged in the heat exchanger capable of effectively vaporizing the liquid passing through tubes.

Another object of this invention is to provide heat transfer tube assemblies each comprising a plurality of improved fins attached to the heat transfer tube capable of preventing adverse effects on the heat transfer tube due to harmful chemical materials contained in the liquid to be evaporated.

According to this invention there is provided a heat exchanger including therein heat transfer tube assemblies each comprising a tube and a plurality of fins secured to the outer surface of the tube in which a high temperature gas is supplied into the heat exchanger from an inlet thereof and discharged from an opposing outlet thereof for performing heat exchange between the high temperature gas and a liquid passing through the heat transfer tube assemblies thereby to vaporize the liquid, wherein each fin is constructed to have a radial length in a direction towards the inlet for the high temperature gas larger than that in a direction towards the outlet therefor.

DESCRIPTION OF THE PREFERRED EMBODIMENTS

Figure 1A:
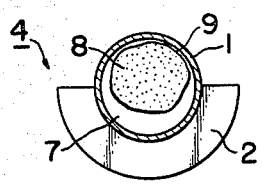
FIGS. 1*a*, 2*a*, 3*a*, and 4*a* are cross-sectional views respectively showing embodiments of heat transfer tube assemblies according to this invention.
Figure 1B:
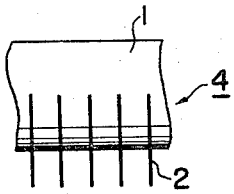
FIGS. 1*b*, 2*b*, 3*b*, and 4*b* are views showing conditions of attaching fins to heat transfer tubes, which correspond respectively to FIGS. 1*a*, 2*a*, 3*a*, and 4*a*.
Figure 2A:
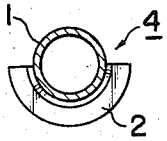
Figure 2B:
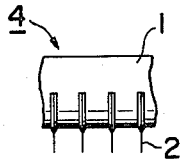
Figure 3A:
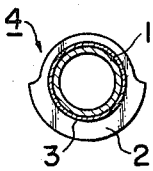
Figure 3B:
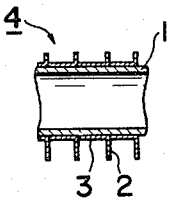
Figure 4A:
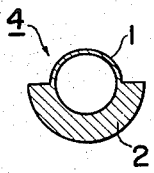
Figure 4B:
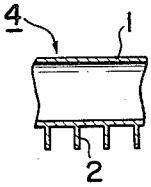

As shown in FIGS. 1*a* and 2*a*, a heat transfer tube assembly 4 comprises a tube 1 and a plurality of semicircular fins 2 each having a predetermined radial length. The fins 2 are attached to the tube 1 about substantially the lower half thereof by welding or any other suitable means as shown in FIGS. 1*b* and 2*b*. Moreover, as shown in FIGS. 3*a* and 3*b*, an outer tube 3 having a plurality of circular fins 2, each provided with an upper half having a short radial length and a lower half having a long radial length, may be tightly fitted to the heat transfer tube, and a plurality of sections of the outer tubes 3 may be fitted over an inner tube 1. Furthermore, as shown in FIGS. 4*a* and 4*b*, fins 2 may be integrally formed with the tube 1.

Figure 5:
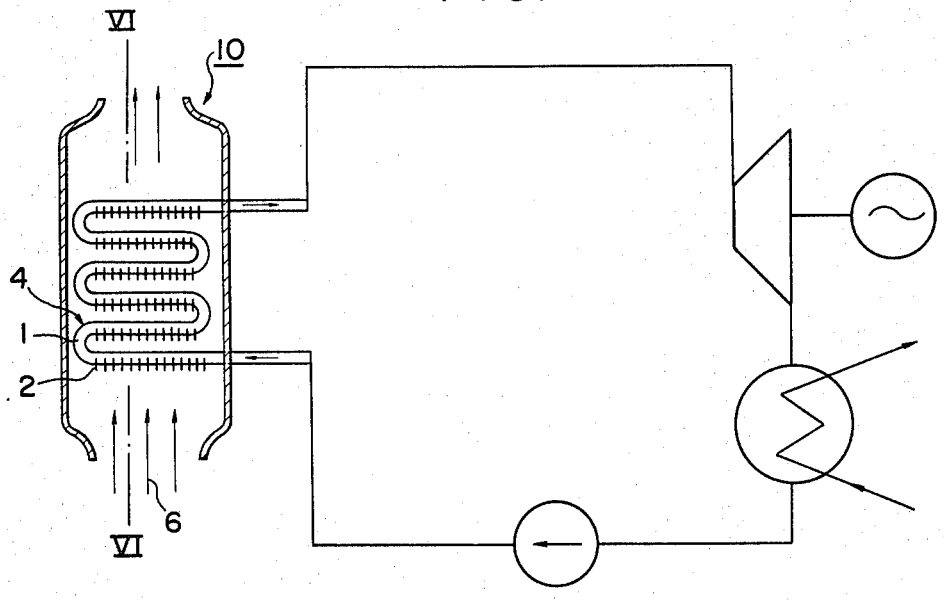
FIG. 5 is a diagram showing a typical Rankine cycle including a heat exchanging system including the heat transfer tube assemblies according to this invention.
Figure 6:
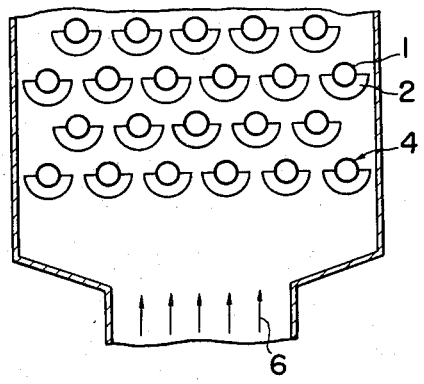
FIG. 6 is a schematic cross-sectional view taken along the line VI—IV shown in FIG. 5.

FIG. 5 is a diagram showing a Rankine cycle system including a heat exchanger 10 in which the heat transfer tube assemblies 4 according to this invention are arranged, and in connection with this FIG. 5, the description regarding the other components is omitted because these components are not directly related to this invention. FIG. 6 clearly shows the arrangement of the heat transfer tube assemblies 4 arranged horizontally in rows in a zigzag form in the heat exchanger shown in FIG. 5. When a high temperature gas 6 is fed into the heat exchanger 10 from the lower inlet thereof, the heat transfer tube assemblies 4 are heated and heat exchange is performed between the high temperature gas 6 and the liquid 7 passing through the heat transfer tubes 1. Thus, the liquid 7 is gradually evaporated thereby to generate vapour. As shown in FIG. 1*a*, the generated vapour 8 passes above the liquid 7 in the tube 1 and at this time a portion of the liquid forms a thin film 9 at the upper portion of the interior of the tube 1.

Because of the provision of the fins 2 only along the lower outer surface of the tube 1, the heat amount transferred at the bottom of the tube to the liquid passing through the tube is increased by a heat amount larger than that applied to the upper portion thereof when the high temperature gas 6 is fed from the lower side of the heat transfer tube assemblies 4 as shown in FIG. 6. Thus, although the liquid passing through the tubes 1 at their lower portions is evaporated, the thin liquid film formed at the upper inner portion of the tubes 1 is not dried out, thereby preventing the dry-out phenomenon. In other words, this means that the inside upper portion of the heat transfer tube is not so much heated that the thin liquid film will be completely dried out even if there were supplied a hot gas having a temperature considerably higher than that supplied in a case where a conventional heat transfer tube provided with fins about its entire outer surface is used.

Figure 7:
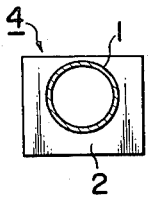
FIG. 7 through FIG. 10 are cross-sectional views showing other embodiments of a heat transfer tube assembly according to this invention.
Figure 8:
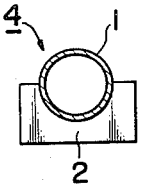

FIGS. 7 through 10 show other embodiments of a heat transfer tube assembly according to this invention. In FIG. 7, a plurality of rectangular fins 2 are provided for a heat transfer tube 1 and the level of the upper edge of the fin 2 is substantially equal to the upper outer surface of the tube 1. In FIG. 8, each fin 2 has a rectangular contour which is attached to the lower half portion of the outer surface of the tube 1.

Figure 9:
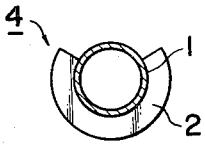
Figure 10:
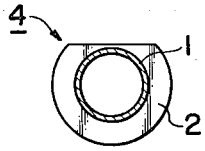

Moreover, in a modification shown in FIG. 9, each fin 2 has substantially a circular contour but the upper portion thereof is cut away in the form of a segment, and in FIG. 10, each fin 2 has also a substantially circular contour but the upper portion thereof is horizontally cut away so that the level of the upper edge of the fin 2 would become substantially equal to the upper outer surface of the heat transfer tube 1.

Consequently, according to this invention, since fins are provided for each tube horizontally arranged in a heat exchanger and a radial length of the fin extending from the lower portion of the tube is determined to be longer than that extending from the upper portion of the tube, the heat amount transferred to the liquid passing through the inner lower portion of the tube is larger than that transferred to the thin liquid film passing through the inner upper portion of the tube when a high temperature gas is fed from the lower side of the tubes. Thus, although the liquid is evaporated to effectively generate vapour, the thin liquid film is prevented from causing dry-out phenomenon and damage to the heat transfer tube caused by the adhesion of harmful chemical materials contained in the liquid can also be avoided. Therefore, it is not necessary to use an expensive liquid treatment device and to construct a heat transfer tube with an expensive anti-corrosion material.

Figure 11A:
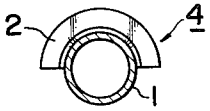
FIGS. 11*a* and 11*b* show still further embodiments of a heat transfer tube assembly which includes fins attached to a tube.
Figure 11B:
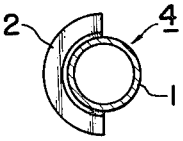

In the foregoing descriptions, although there are disclosed several types of heat transfer tube assemblies each of which comprises a plurality of fins each having a radial length at the lower portion of the tube which is larger than that at the upper portion thereof, as one example as shown in FIGS. 11*a* and 11*b*, the fins can be secured to the upper or side outer surface of the tube and these finned tube assemblies are arranged in a heat exchanger in a manner that the fins are directed to the hot gas inlet portion of the heat exchanger.

The use of these finned heat transfer tube assemblies in a heat exchanger in rows in a zigzag form eliminates the arranging space of the assemblies in the heat exchanger and effectively exchanges heat between the finned tube assemblies and the high temperature gas, without causing problems regarding the liquid to be evaporated, such as dry-out phenomenon.

It is to be understood that this invention is not limited to the construction and arrangement illustrated in the accompanying drawings and changes and variations may be made without departing from the spirit and scope as defined in the appended claims.

I claim:

1. A heat exchanging method for generating a vapor from a liquid while preventing a dry out condition in the tubes of a heat exchanging device comprising the steps of:

providing a heat exchanging device comprising an inlet located at a lower portion of said heat exchanging device, an outlet located at an upper portion of said heat exchanging device and internal heat transfer tube assemblies mounted in a fluid flow path of said device between said inlet and outlet, each tube assembly comprising a tube and a plurality of plate-like fins secured to the outer surface of said tube to extend radially therefrom, said tubes being arranged horizontally and each of said fins being secured to the outer peripheral surface of only the lower half of an associated tube from one side thereof to the other and functioning to prevent overheating of an upper half of the associated tube;

feeding a high temperature gas into the inlet of said heat exchanging device and through said fluid flow path; and passing a liquid through said tube assemblies and vaporizing said liquid by heat from said high temperature gas to form within at least one of said tubes a liquid vapor and a thin liquid film along an upper inner wall of said at least one tube, said fins which are only at the lower surface of said tubes preventing the overheating of an upper half of said at least one tube and a drying out of said thin liquid film therein.

* * * * *